US007182209B2

(12) United States Patent
Squitieri

(10) Patent No.: US 7,182,209 B2
(45) **Date of Patent: *Feb. 27, 2007**

(54) GLIDE

(75) Inventor: Anthony C. Squitieri, Monroe, CT (US)

(73) Assignee: Display Technologies, LLC, College Point, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/361,081

(22) Filed: Feb. 23, 2006

(65) Prior Publication Data

US 2006/0138065 A1 Jun. 29, 2006

(51) Int. Cl.
*A47F 5/08* (2006.01)
*A47F 1/00* (2006.01)

(52) U.S. Cl. ..... 211/59.2; 211/59.1; 211/74; 211/184; 312/45

(58) Field of Classification Search ..... 211/59.2, 211/59.3, 74, 175, 184; 312/42, 45, 61, 71, 312/72; D6/408, 467, 473, 515
See application file for complete search history.

(56) References Cited

U.S. PATENT DOCUMENTS 2,218,444 A 10/1940 Vineyard
2,572,090 A 10/1951 Allen
3,954,184 A * 5/1976 Mendenhall ..... 211/184
4,191,299 A * 3/1980 Moore ..... 211/184
4,205,763 A 6/1980 Merl
4,328,902 A 5/1982 North
4,416,380 A 11/1983 Flum
4,454,949 A 6/1984 Flum
D275,058 S 8/1984 Flum
4,470,943 A 9/1984 Preis
4,474,491 A 10/1984 Ferrarelli
4,478,337 A 10/1984 Flum
4,593,823 A 6/1986 Fershko et al.
D290,790 S 7/1987 Nathan et al.
4,694,966 A 9/1987 Sorenson et al.
4,801,025 A 1/1989 Flum et al.
4,809,855 A 3/1989 Bustos
4,858,774 A * 8/1989 Winter et al. ..... 211/184
4,925,037 A 5/1990 Holley, Jr.
4,958,739 A 9/1990 Spamer
4,997,094 A 3/1991 Spamer et al.
5,024,336 A 6/1991 Spamer
5,119,945 A 6/1992 Wiggins
5,190,186 A 3/1993 Yablans et al.
5,240,126 A 8/1993 Foster et al.
5,265,738 A 11/1993 Yablans et al.
5,287,974 A * 2/1994 Buday ..... 211/184
5,351,838 A 10/1994 Flum
5,450,968 A 9/1995 Bustos
5,562,217 A 10/1996 Salveson et al.
5,624,042 A 4/1997 Flum et al.
5,634,564 A 6/1997 Spamer et al.

(Continued)

*Primary Examiner*—Jennifer E. Novosad
(74) *Attorney, Agent, or Firm*—Carter, DeLuca, Farrell & Schmidt, LLC

(57) ABSTRACT

A glide (20) includes a base (22), a front member, and a number of walls (26) extending front-to-back. Both the base and the front member are advantageously formed as a number of pieces secured side-by-side to provide expandability. The front member may be secured to the walls via dovetail interaction and different front members may be provided for different wall spacings.

19 Claims, 10 Drawing Sheets

U.S. PATENT DOCUMENTS 5,645,176 A 7/1997 Jay
5,685,664 A 11/1997 Parham et al.
5,788,091 A 8/1998 Robertson et al.
D401,436 S 11/1998 Jay
5,904,256 A 5/1999 Jay
6,068,142 A 5/2000 Primiano
6,082,556 A 7/2000 Primiano et al.
6,082,558 A 7/2000 Battaglia
6,098,821 A * 8/2000 Dube et al. ..... 211/184
6,129,218 A 10/2000 Henry et al.
6,142,316 A 11/2000 Harbour et al.
6,164,462 A 12/2000 Mumford
6,234,328 B1 5/2001 Mason
6,237,784 B1 5/2001 Primiano
6,276,538 B1 8/2001 Battaglia et al.
6,325,221 B2 12/2001 Parham
6,513,667 B2 2/2003 Battaglia et al.
6,523,702 B1 2/2003 Primiano et al.
6,527,127 B2 * 3/2003 Dumontet ..... 211/59.3
6,705,477 B1 * 3/2004 Narkis et al. ..... 211/153
7,083,054 B2 * 8/2006 Squitieri ..... 211/59.2
2001/0002658 A1 6/2001 Parham
2001/0020604 A1 9/2001 Battaglia et al.

* cited by examiner

GLIDE

CROSS-REFERENCE TO RELATED APPLICATIONS

This patent application claims priority to U.S. Patent Publication No. 2002/0179,553 filed on Jun. 7, 2002 entitled "Glide," which claims priority to U.S. Provisional Patent Application Ser. No. 60/169,606 entitled "Glide" that was filed on Dec. 8, 1999, the entire contents of these disclosures are hereby incorporated by reference herein.

BACKGROUND OF THE INVENTION (1) Field of the Invention

This invention relates to glides, and more particularly to retail display glides for holding a number of beverage containers.

(2) Description of the Related Art

There are a wide variety of devices for storing, displaying, and dispensing products such as individual beverage containers. A broad genus of such devices are known as glides. Such glides confine the good to discrete lanes (often designated rows or columns), typically arrayed extending front-to-back in a refrigerator, display case, or shelf unit. Many such glides are configured or mounted so that the glide base surface supporting the goods inclines from front to back to allow a back-to-front gravity feed.

U.S. Pat. No. Des. 275058 discloses one basic glide. The glide has a given footprint on the associated shelf or other support surface.

Glides have been provided which are reversibly or permanently alterable to accommodate and available shelf footprint. U.S. Pat. No. 4,478,337 identifies a glide having front and rear portions which slidingly interfit to permit adjustment of the front-to-back length of the glide. U.S. Pat. No. 4,958,739 discloses a glide in which a rear portion is disjointably coupled to a front portion to permit size adjustment by the addition or removal thereof. U.S. Pat. No. 4,801,025 discloses a stackable glide system wherein outboard lanes may be severed from the glide to narrow it.

U.S. Pat. No. 5,904,256 discloses a system wherein individual lane-defining members may be secured side-by-side to form a composite glide. In addition to producing individual members of a single lane in width, the assignee of that patent is believed to make one-piece members which define multiple (e.g., three) lanes.

There, however, remains a need in the art for an improved glide with the ability to effectively accommodate a variety of product sizes.

BRIEF SUMMARY OF THE INVENTION

Accordingly, in one aspect, the invention is directed to a glide apparatus for holding a number or group of items. A base has front, back, left, and right ends, an upper surface for supporting the items, and a bottom surface. At least some of a number of wall members are removably installable on the base, extending front-to-back so as to cooperate with the base to define a number of channels. Each channel is dimensioned for accommodating an associated front-to-back column of the items. A front member is installable to the base and to the installed wall members to bound forward extremities of the channels.

In various implementations, the base may comprise a molded plastic primary base member or piece and at least one molded plastic auxiliary base member or piece, removably assembled side-by-side. The front member may comprise a molded plastic primary front member and at least one molded plastic auxiliary front member, removably assembled side-by-side. The items may be beverage containers such as plastic bottles, glass bottles, and metal cans.

The front member may be first front member, including a number of wall member-engaging features at substantially a first pitch. The first pitch may define an associated pitch of the channels. A second front member may be provided having similar wall member-engaging features spaced at a substantially different second pitch. The installed wall members may be removable and reinstallable so as to engage the features of the second front member and define a second group of channels for accommodating a second group of containers having a substantially different diameter than the first group. Each auxiliary front member may include one of the wall member-engaging features along a first side thereof. The auxiliary front members may front a group of the channels at a different pitch from those front members fronted by the primary front member.

Each wall member may include top, bottom, front, and rear edges. At least two forward-directed fingers may depend from the bottom edge. The wall members may be installable on the base by inserting such fingers downward through associated slots in the base and shifting the wall members forward so that an upper surface of each finger engages the bottom surface of the base. The front edge of each wall member may include a vertically-extending projection engageable via vertical translation to a complementary channel in the front member. The front member, when installed to the base and to the installed wall members, may have surfaces cooperating with complementary surfaces of the base. This cooperation may prevent a rearward shift of the installed wall members so as to prevent removal of the installed wall members unless the front member is at least partially disinstalled via vertical translation. The front member may include a number of apertures, each aperture associated with one of the channels and effective to allow at least partial viewing of a lead item in the associated column of the associated channel.

In another aspect, the invention is directed to a kit for forming a retail display glide apparatus for holding a number of containers. The kit includes a primary base member and a number of auxiliary base members each having a width substantially less than a width of the primary base member and configured to be selectively assembled with the primary base member in a side-by-side configuration to form a glide base. At least some of a number of wall members are selectively installable in the base extending front-to-back so as to cooperate with the base to define a number of channels, each channel for accommodating the associated front-to-back column of the containers. Wall members are so installable alternatively in at least two sets of positions corresponding to two different nominal channel widths. At least two front member assembly kits are respectively associated with the channel widths. Each front member assembly kit includes a primary front member and a number of auxiliary front members configured to be selectively assembled with the primary front member to form a front member assembly. The front member assembly is attachable to the base and to the installed wall members so as to bound forward extremities of the channels.

In various implementations of the invention, each front member assembly, along back surfaces of its primary and auxiliary front members, may include a number of concave surface portions respectively aligned with the channels for accommodating the front container in each associated column. The primary and auxiliary base members may each be single pieces of molded plastic including a number of pairs of front and back longitudinal slots. Each wall member may be a single piece of molded plastic and have a plurality of holes inboard of its edges. A pair of front and back forward-projecting fingers may depend from the bottom edge and be insertable through an associated pair of the slots to interlock the wall member to the glide base via a subsequent forward translation of the wall member. The wall members may also include a vertically-extending projection along the front edge. Each front member assembly may include a number of vertically-extending channels complementary to the vertically-extending projection to interlock the front member assembly with the installed wall members upon a relative vertical translation.

In other aspects, the invention is directed to a front member for such a glide apparatus.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
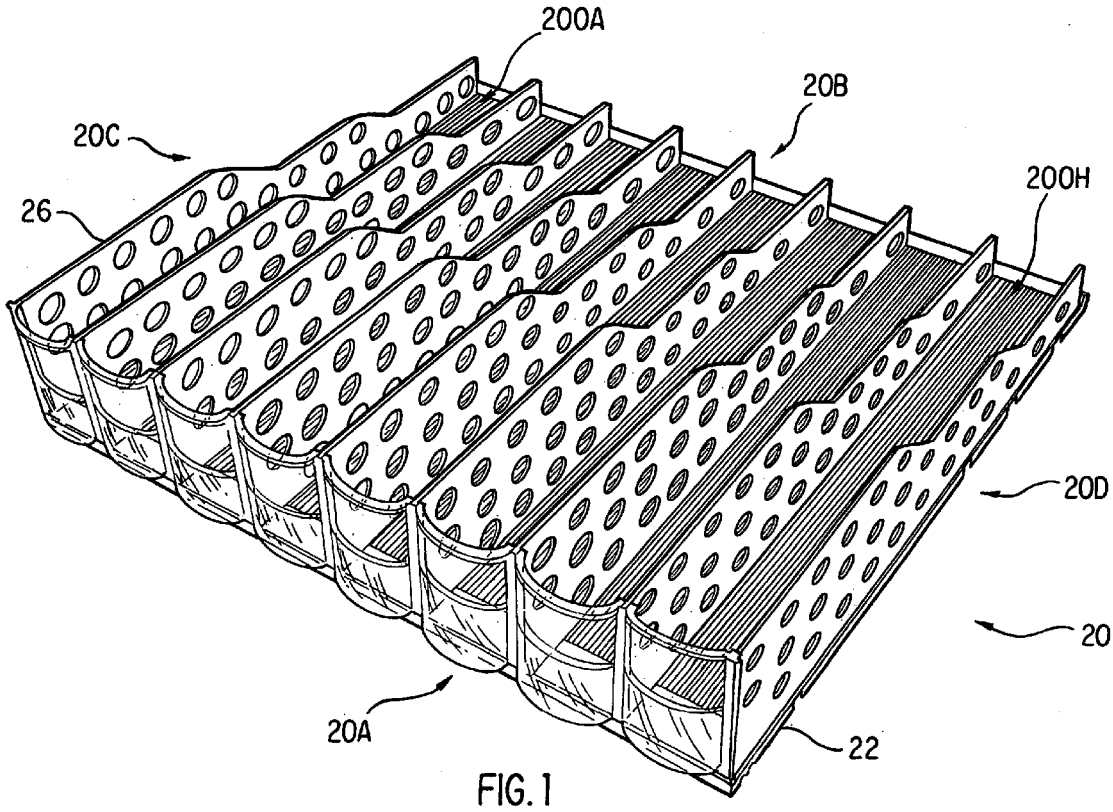
FIG. 1 is a view of a glide according to principles of the invention.
Figure 2:
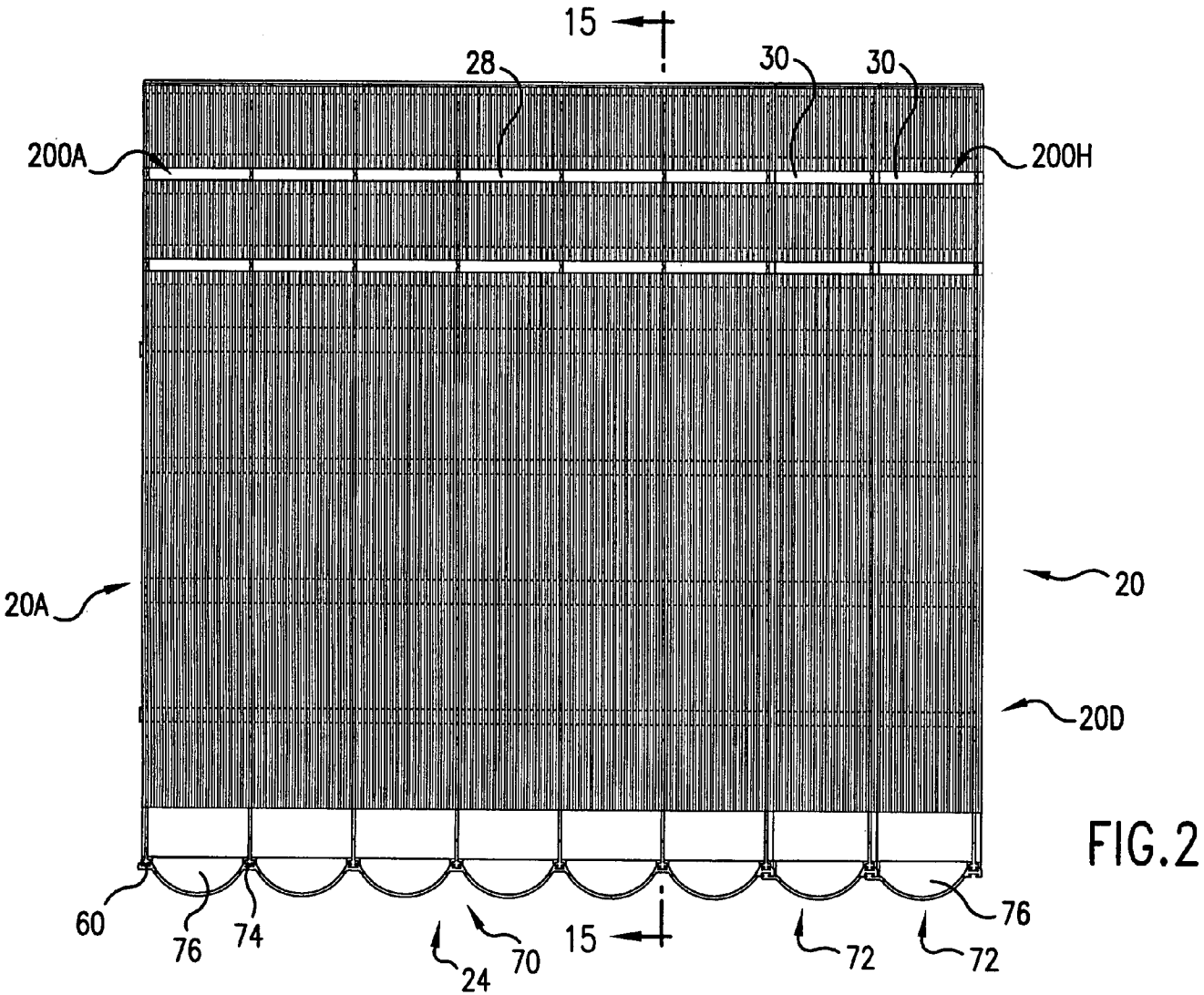
FIG. 2 is a top view of the glide of FIG. 1.

FIG. 1 shows an assembled glide 20 having a front 20A, a back 20B, a left side 20C, and a right side 20D (left and right are from the perspective of a user facing the glide front). The glide defines a plurality of side-by-side lanes from a leftmost lane 200A to a rightmost lane 200H. Each lane has a width and length effective to accommodate an associated front-to-back column of beverage containers. The glide comprises the separately-formed combination of a base 22, a front member 24, and a plurality of dividers or wall members (walls) 26. Each lane is formed as a generally right channel comprising the adjacent side surfaces of the adjacent walls and the adjacent portion of the upper surface of the base. As is better seen in FIG. 2, the base 22 includes a primary member 28 and two auxiliary members 30 assembled side-by-side. The primary member 28 is substantially wider than the auxiliary members 30, which, in the exemplary embodiment, are identical to each other and are assembled together at the right side of the primary member 28. The ability to assemble one or more auxiliary base members to the primary base member allows the glide width to be adjusted to approximately correspond to the available width in the refrigerator or display case.

Figure 3:
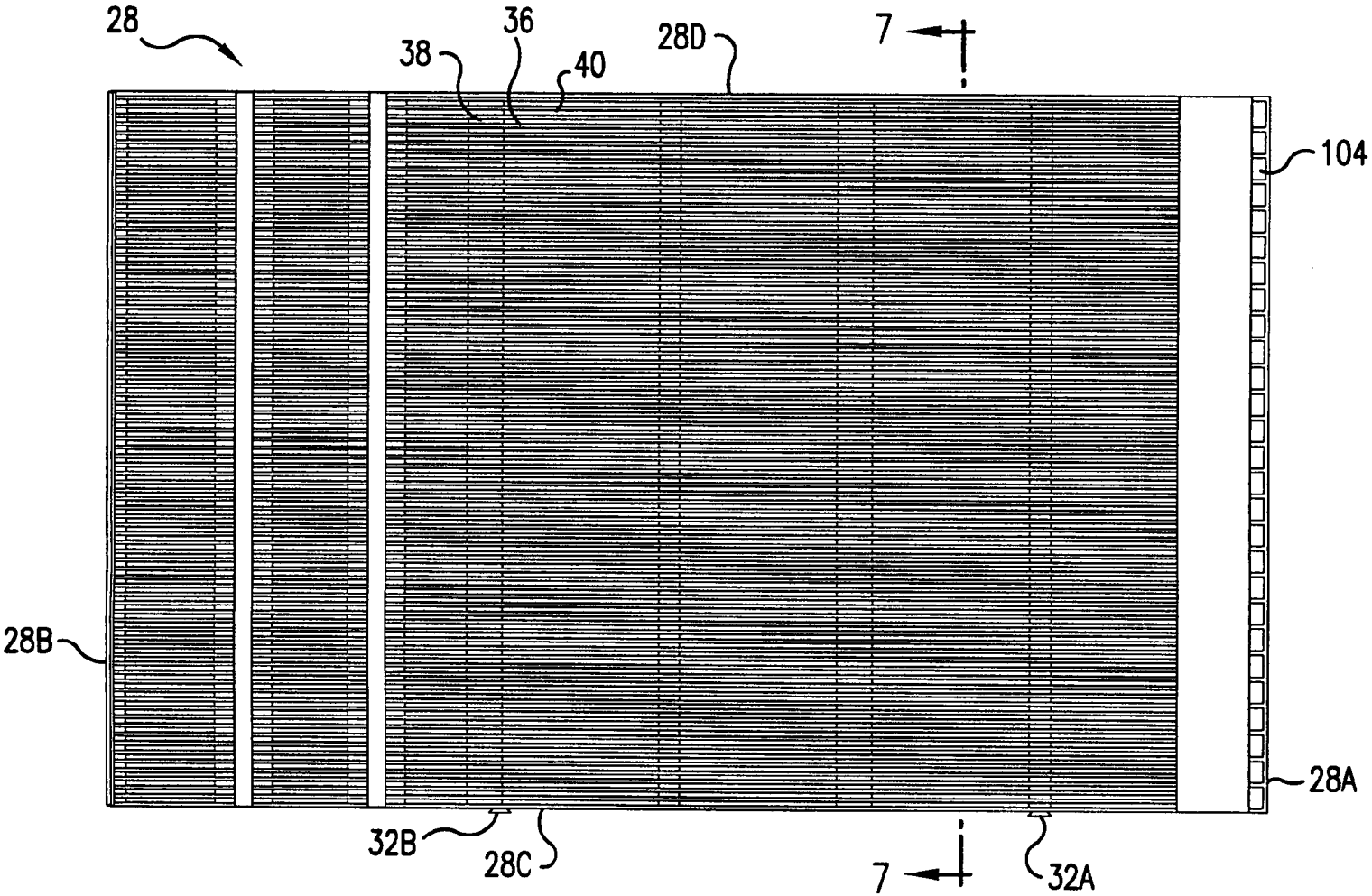
FIG. 3 is a top view of a primary piece of a base of the glide of FIG. 1.
Figure 4:
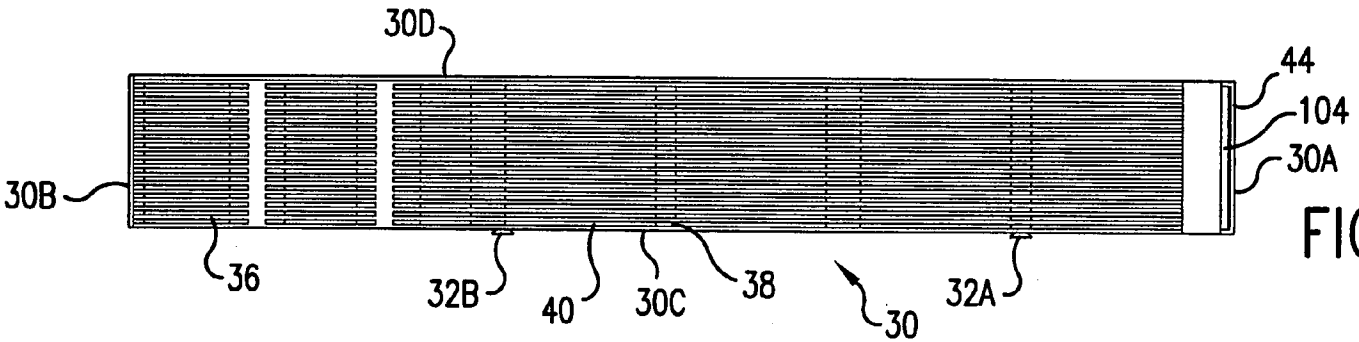
FIG. 4 is a top view of an auxiliary piece of the base of the glide of FIG. 1.
Figure 6:
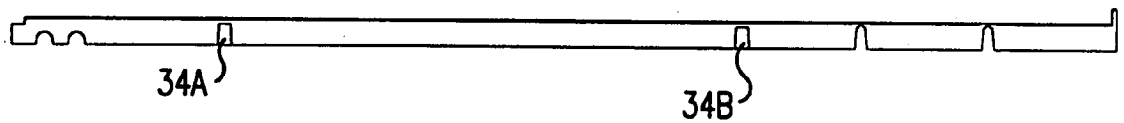
FIG. 6 is a right side view of the auxiliary piece of FIG. 4.
Figure 7:
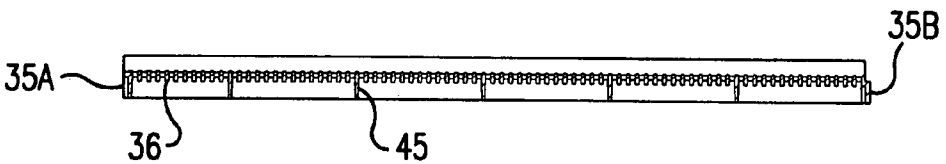
FIG. 7 is a transverse cross-sectional view of the primary base piece of FIG. 3.

FIG. 3 shows the primary base member 28 prior to assembly of the glide. The primary base member has front, back, left, and right ends 28A–28D. Similarly, FIG. 4 shows the front, back, left, and right ends 30A–30D of one of the auxiliary base members 30. The left end or side 30C includes a pair of vertically-extending dovetail projections 32A and 32B, the faces of which are seen in the left side view of FIG. 5. The right sides 28D and 30D of the primary and auxiliary base members bear dovetail channels 34A and 34B (FIG. 6) complementary to the projections 32A and 32B, respectively. The primary base member may omit the projections 32A and 32B in an embodiment which allows auxiliary members to only be assembled to one side of the primary member. In the exemplary embodiment, each base member is a single molded plastic piece having left and right sidewalls (35A and 35B for primary base member 28 in FIG. 7), a plurality of front-to-back rails 36 (the upper surfaces of which support the containers) and a plurality of cross-members 38 spanning between the sidewalls and combining with the sidewalls and rails to form a grid of slot-like ventilation/drainage apertures 40. In the exemplary embodiment, the channels 34A and 34B are formed as openings in the right sidewall of the unitary plastic (e.g., opaque medium impact styrene) molding forming the associated base member. Each base member further includes a rear wall 42, (FIG. 5) having a height greater than the remainder of the base so as to project upward above the upper surfaces of the rails and sidewalls. Each base member includes a front wall 44 (FIG. 4) shorter than the remainder of the base member (FIG. 5) so that its upper extremity is recessed below the upper surfaces of the rails as described in further detail below. Near its front wall, each base member may have one or more upward-directed recesses for capturing a lip along the front edge of a shelf to retain the glide on the shelf. Alternatively, or additionally, downward-directed projections may be provided to engage the elements of a wire shelf or engage mating features of other shelving. This can provide a desired front-to-back location of the glide on the shelf. This may further be facilitated by providing features for securing the glide to the shelf. For example, channels may be provided in the upper surface of the base behind the front member to accommodate tie wraps extending through the base and engaging a wire shelf or the like.

In the exemplary embodiment, the primary base member includes a number of additional longitudinal structural walls 45 at approximately regular transverse intervals and approximately vertically coextensive with the sidewalls 35A and 35B. In the exemplary embodiment, the walls 45 also serve as rails, each wall 45 in place of an associated vertically shorter rail 36 at the particular transverse location. A relatively narrow auxiliary base member may have sufficient strength in the absence of such walls 45. In one exemplary embodiment, the base members have an overall length of approximately 26 inches (66 cm), a height at the rail upper surface of approximately 0.6 inches (1.5 cm), a rear wall height of approximately 1.0 inches (2.5 cm), and a rail height of approximately 0.3 inches (0.7 cm). The exemplary primary base member width is approximately 21.45 inches (54.5 cm) and the auxiliary base member width is approximately 3.51 inches (8.92 cm).

Figure 8:
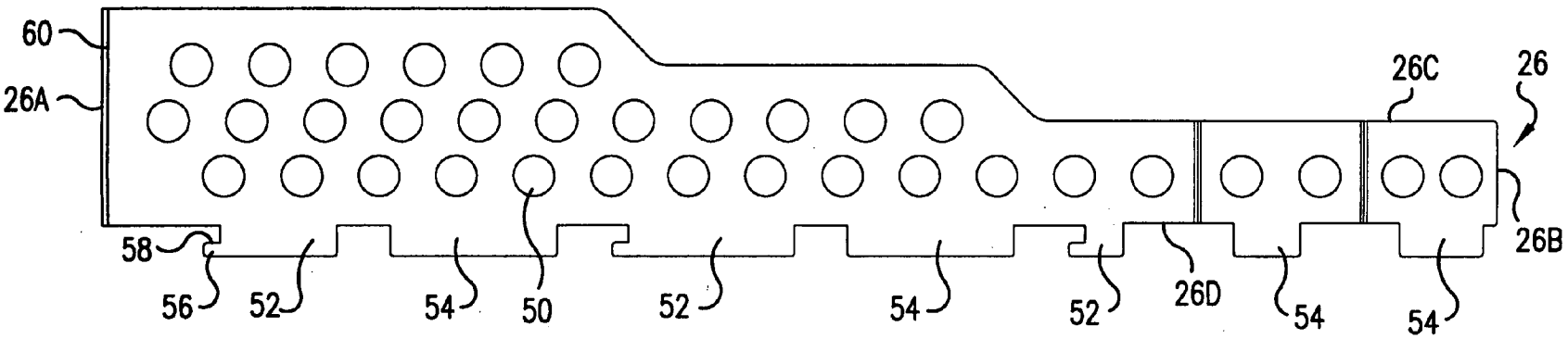
FIG. 8 is a right side view of a wall of the glide of FIG. 1.

FIG. 8 shows features of a wall 26. The wall 26 includes front, back, top, and bottom edges 26A–26D and left and right side surfaces. The wall features an array of ventilation apertures 50 permitting airflow between the lanes. A plurality of projections 52 and 54 depend from the bottom edge. At least some of the projections (e.g., the projections 52) include forward directed fingers 56 having an upper surface 58 spaced apart from and facing the bottom edge 26D. Along the front edge 26A, the wall includes a vertically-extending dovetail projection 60. Advantageously, the wall is of a height sufficient to maintain the containers within their respective lanes. To achieve this, the height is advantageously sufficient so that the top edge 26C is near or above the center of gravity of the containers in the adjacent one or two lanes. This is particular advantageous near the front of the glide as a gravity-feed action will cause the containers toward the front of a given lane to experience higher skewing forces than containers toward the back of that lane. The wall may have an exemplary height of 5.0 inches (13 cm) which is advantageous for relatively tall containers such as one-liter plastic carbonated beverage bottles and thirty-two-oz. (946 ml) glass juice bottles. This height facilitates a three row high array of one inch diameter ventilation apertures. For twelve-oz. (355 ml) cans, a 3.5 inch (9 cm) high wall with two rows of such apertures is a possibility. Each wall is advantageously molded as a single plastic piece (e.g., of opaque or translucent polypropylene). The illustrated wall may have an effective height of approximately 3.9 inches (10 cm) at its front, stepping down to approximately 1.9 inches (4.8 cm) at its back in a material-saving compromise. By molding the walls separately from the base and front member, it is relatively easy to include the ventilation apertures and provide such apertures within the body of the wall (i.e., not open to the wall edges).

Figure 5:
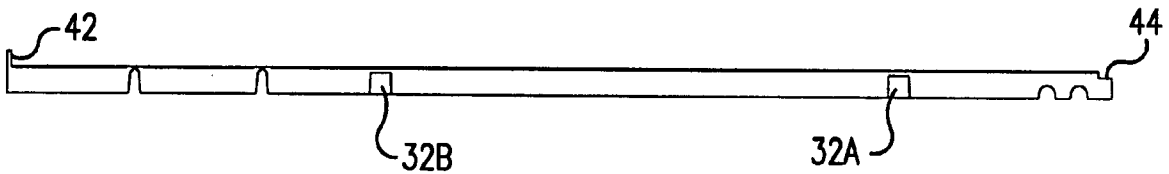
FIG. 5 is a left side view of the auxiliary piece of FIG. 4.
Figure 9:
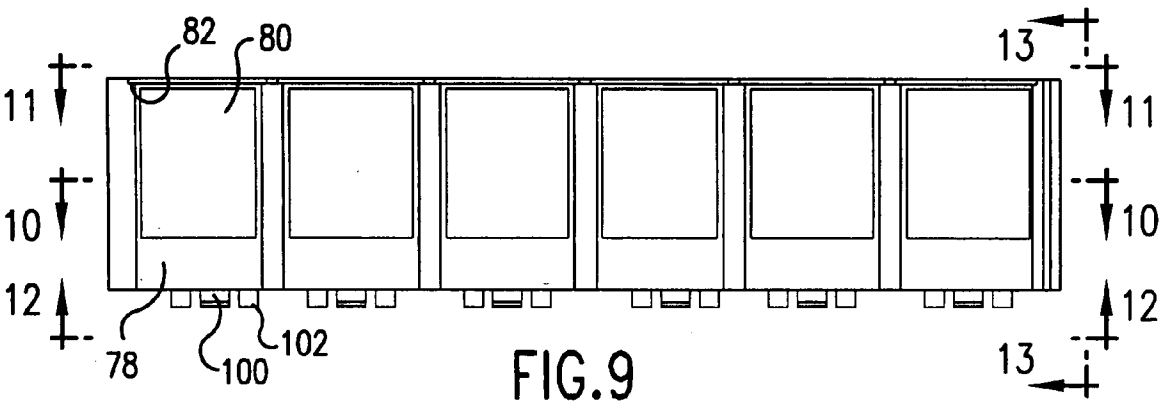
FIG. 9 is a front view of a primary piece of a front of the glide of FIG. 1.
Figure 10:
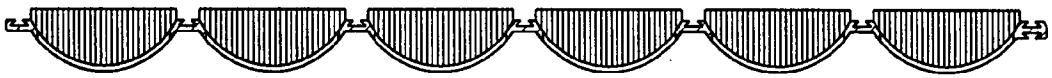
FIG. 10 is a cross-sectional view of the primary front piece of FIG. 9, taken along line 10—10.

Returning to FIG. 2, the front member 24 includes a primary member 70 and a number of auxiliary members 72 assembled side-by-side. In the exemplary embodiment, each of the members 70 and 72 is formed as a single molded plastic piece (e.g., of transparent polycarbonate). The front member includes a plurality of vertically-extending dovetail channels 74 complementary to the projections 60 of the walls 26. The front member 24 defines the forward extremities of the lanes, having a slightly sub-semicircular floor portion 76 associated with each lane and having an upper surface substantially coplanar with the upper surface of the base when assembled. This coplanar or flush assembly is facilitated by allowing an aft extremity of the floor portion 76 to be accommodated by the vertical recess at the front wall 44 (FIG. 5). FIG. 9 shows further details of the front member with respect to its primary piece 70. For each lane, extending upward from the floor portion 76 is an arcuate wall portion 78 having a central aperture 80. Above the aperture, at the top of the front member, a crown portion 82 projects radially outward (relative to the wall center of curvature) providing additional structural integrity. Additionally, the location of the top of the front member is preferably at a height sufficiently near or above the center of gravity of the beverage containers so that the lead container in the lane will not fall over the front member (especially if the glide is positioned with a rear-to-front decline). Furthermore, the aperture 80 is advantageously sized to allow viewing of a substantial portion of any label or graphic on the lead container. The inner surface 84 of the wall 78 has a radius of curvature approximately equal to but preferably slightly greater than the maximum radius of the container which the particular front member is designed to accommodate in the associated lane.

Figure 11:
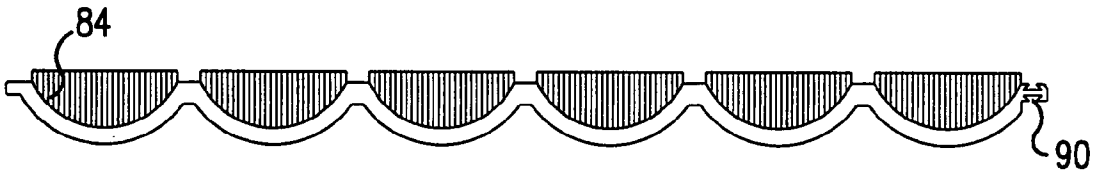
FIGS. 11, 12, and 13 are top, bottom and right side views of the primary front piece of FIG. 9.
Figure 12:
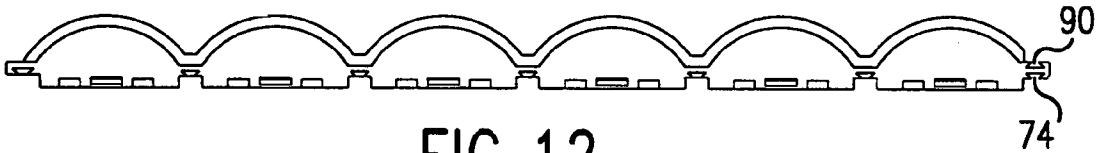
Figure 14:
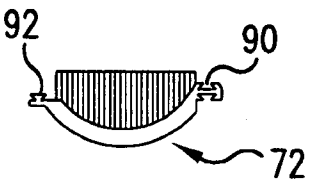
FIG. 14 is a top view of an auxiliary front piece of the glide of FIG. 1.

To permit the primary and auxiliary front pieces 70 and 72 to be assembled to each other, at its rightmost extremity immediately in front of the dovetail channel 74 each of the pieces 70 and 72 includes a single vertically-extending, forward-facing, dovetail channel 90 (FIGS. 11, 12 and 14). Along its left side, each auxiliary piece 72 includes a single, vertically-extending, rearward-facing, dovetail projection 92 (FIG. 14), complementary to the channels 90.

To assemble the glide, the primary and auxiliary base members are assembled to each other by mating the projections 32A and 32B of each such member with the channels 34A and 34B of the member to its left by a relative downward vertical movement of the left member relative to the right. To ease engagement and facilitate proper vertical alignment, the projections 32A and 32B and channels 34A and 34B may be provided with a slight bottom-to-top taper.

Figure 15:
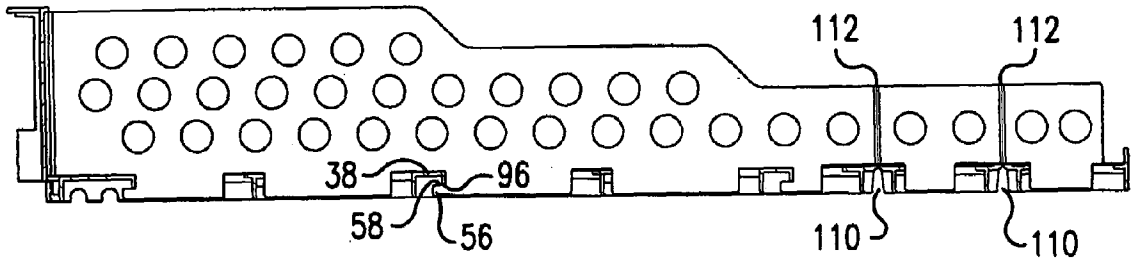
FIG. 15 is a longitudinal sectional view of the glide of FIG. 2 taken along line 15—15.
Figure 17:
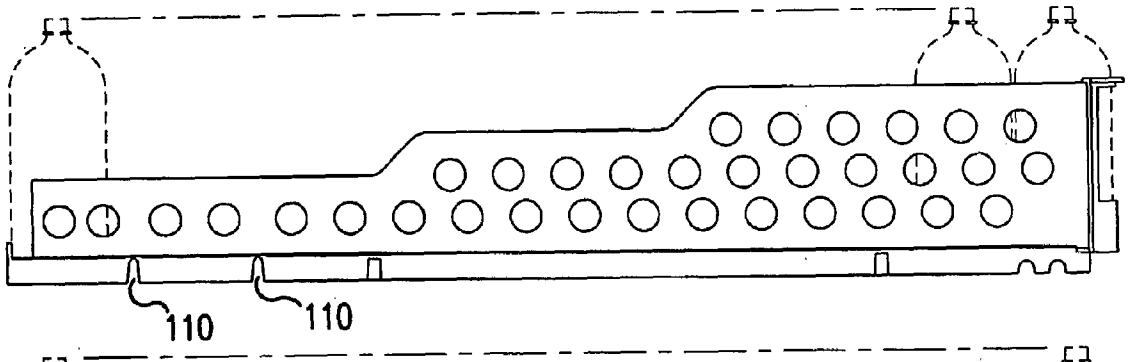
FIG. 17 is a left side view of the glide of FIG. 1 showing a leftmost column of beverage containers in a leftmost lane.
Figure 18:
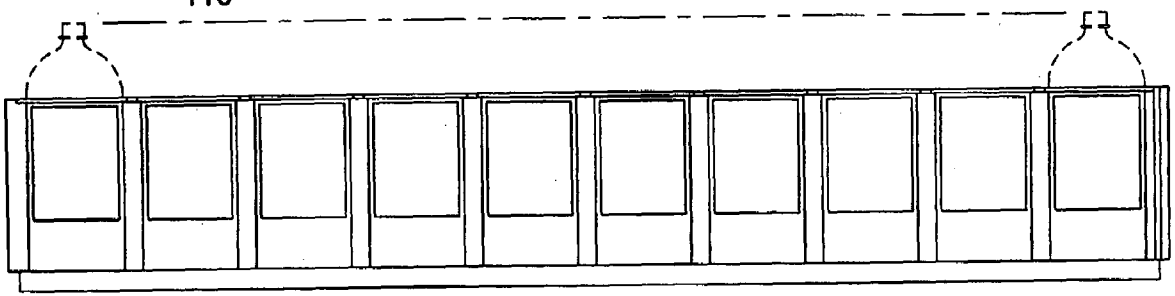
FIG. 18 is a front view of the glide of FIG. 1 showing the lead beverage containers in a plurality of columns of beverage containers.
Figure 19:
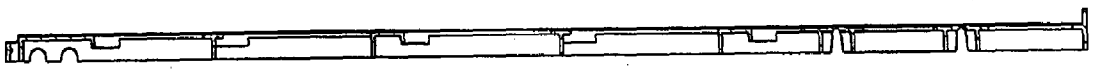
FIG. 19 is a longitudinal cross-sectional view of the primary base piece of FIG. 3.

With the base assembled, the walls are then advantageously installed. To do this, the necessary number of walls (for the base width and desired lane width) are aligned at the appropriate pitch for the desired lane width and lowered so that their projections 52 and 54 pass into associated ones of the slots 40. When this is done, each wall is then shifted forward to an installed position (FIG. 15) so its fingers 56 pass beneath adjacent ones of the cross-members 38. In the illustrated position engagement of the upper surfaces 58 of the fingers 56 with underside surface portions 96 of the cross-members 38 prevents the wall from being shifted vertically upward relative to the base. Forward-facing root portions of any of the projections 52 and 54 may contact aft surfaces of the cross-members 38 to prevent further forward movement of the wall relative to the base.

Figure 13:
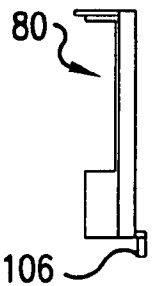
Figure 16:
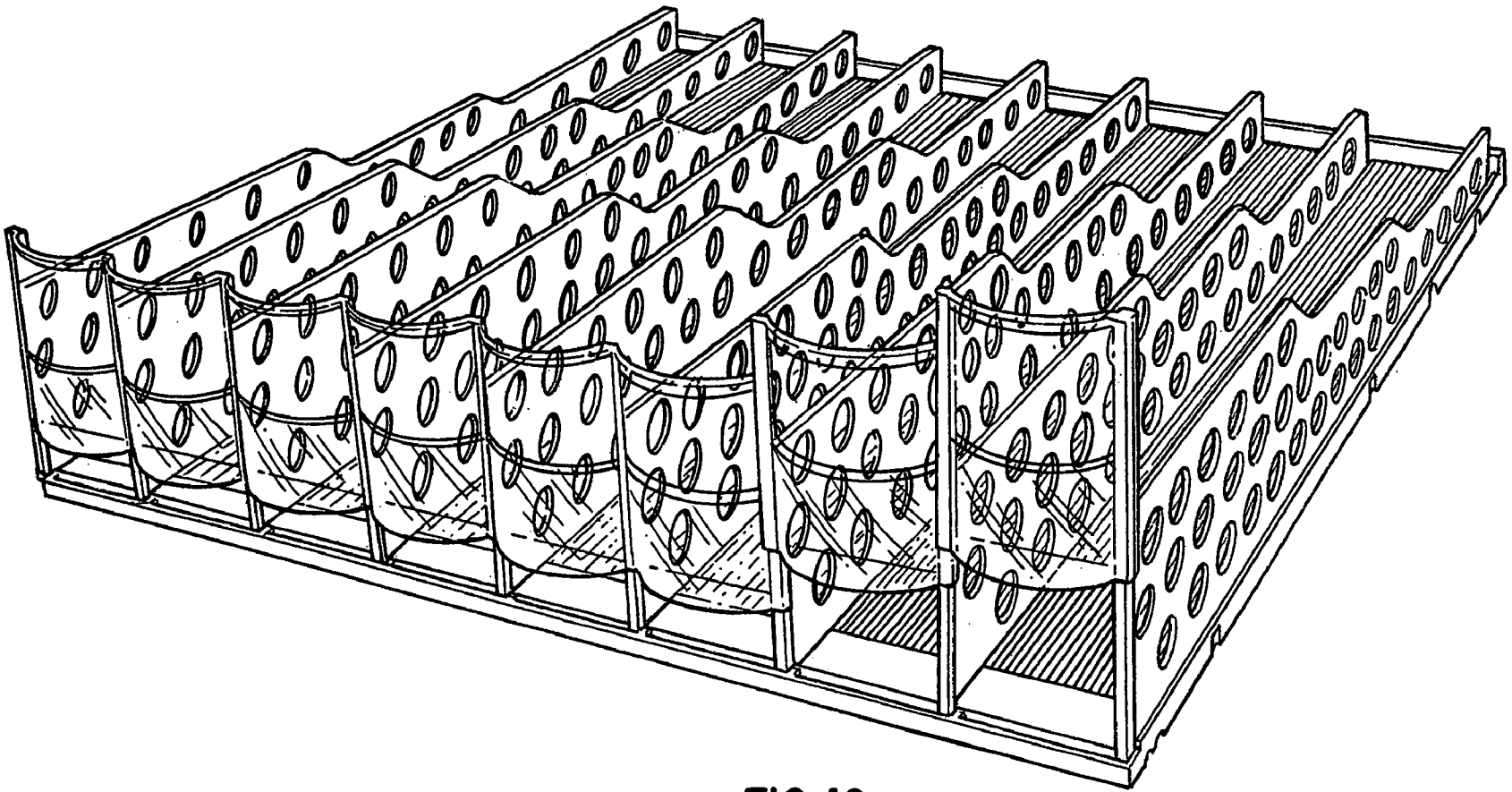
FIG. 16 is a view of the glide of FIG. 1 showing front member pieces partially installed.

With the walls in the installed position, a front member may then be installed either as a unit or in its pieces. This is done via a downward vertical translation of the front member so that its dovetail channels 74 receive the projections 60 (the front member pieces being or having been assembled to each other via vertical translation engaging the dovetail channels 90 with the projections 92). FIG. 16 shows the front member pieces in an intermediate condition of installation. As the front member moves downward to its final installed position (FIG. 15), projections 100 and 102 (FIG. 9) depending from the floor portion 76 enter transverse slot-like apertures 104 (FIG. 3 and FIG. 4) immediately behind the front wall portions of the base pieces 28 and 30. In the exemplary embodiment, each auxiliary base piece has a single aperture 104 while, for structural integrity of its front wall portion, the primary base piece has a number of apertures 104 separated by the walls 45. In the exemplary embodiment, each projection 100 is associated with a pair of projections 102 on either of its sides, there being just one set of three such projections on each auxiliary front member but a plurality on the primary front member. In the exemplary embodiment, each projection 100, along its lower extremity, has a forward directed barb 106 (FIG. 13) for engaging a complementary groove in the aft surface of the associated base piece front wall to serve as a detent holding the front member in its installed position. With the projections 100 and 102 captured within the apertures 104, interaction of the projection with the aft surface of the apertures 104 prevents rearward translation of the walls 26 (which are locked to the front member via cooperation of their associated dovetail projections 60 and channels 74) from the installed position. Since the walls can't be shifted to their rear position, they can't be removed until the front member is at least partially removed via upward translation. In an alternative embodiment (not shown) the projections 100 and 102 are replaced by longitudinally-extending rib-like projections dimensioned to fit within the apertures 104. In one possible implementation, such projections could be placed at an even pitch (e.g., to engage every third aperture 104), with the first projection associated with the leftmost front member and engaging the leftmost aperture.

When distributed as a kit, a maximal kit would include a primary base member and sufficient auxiliary base members to form a base of the maximum anticipated width. The kit would include one or more front member kits, each for a different size container and including a primary front member and sufficient auxiliary front members for the maximum anticipated width. The kit would further include sufficient wall members (of one or more heights) as may be warranted by the various front member kits.

It is possible to configure the glide for simultaneous use with different sizes of beverage containers by combining front member pieces dimensioned for such different size containers (e.g., a primary front member piece dimensioned for twelve-oz. (355 ml) cans with secondary pieces dimensioned for sixteen-oz. (473 ml) bottles).

Provisions may be made to accommodate various depths of available refrigerator space. In the exemplary embodiment, the base members and walls are molded in maximum anticipated lengths which define the maximum glide depth. Where such depth is unavailable in the refrigerator, the glide may be shortened. To facilitate this, the base member sidewalls and any intermediate structural walls 45 are provided with upward-directed reliefs 110 at a plurality of locations along the length of the base member. At aligned locations, each wall 26 includes a relief 112 extending vertically along at least one of the wall side surfaces. The user may apply torque at the reliefs 110 and 112 so as to break off one or more rear lengths of the base members and walls at preferential yield zones defined by those reliefs. In such a way, the depth of the glide can be shortened to accommodate the available refrigerator depth. Optionally, a more complicated system may be provided in which the shortening is reversible. In another example of an alternative embodiment, the system may be made expandable front-to-back as it is expandable side-to-side. By way of example, the base members may have a rear wall which does not protrude above the surfaces defining the associated lanes. The rear wall may include interengagement features such as dovetail projections or channels engageable with complementary features in the front wall of an extension member. The extension members may be provided in the same width as the existing base members or in other appropriate widths. For example, one extension member may span multiple of the existing base members. When so extended front-to-back, correspondingly longer dividers 26 may be utilized or auxiliary dividers may be provided to effectively extend the dividers 26.

Figure 23:
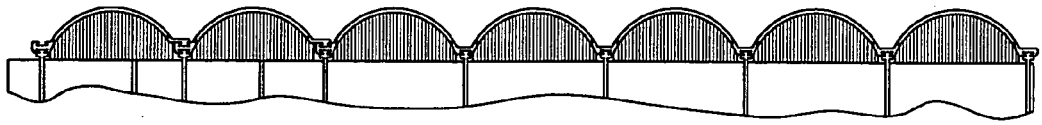
FIGS. 20–23 are partial semi-schematic top views of four different front members alternatively installed on a single base.
Figure 22:
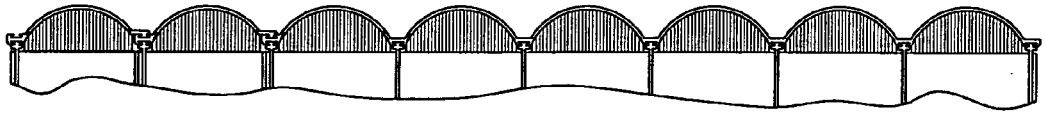
Figure 21:
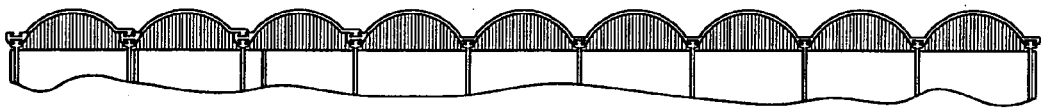
Figure 20:
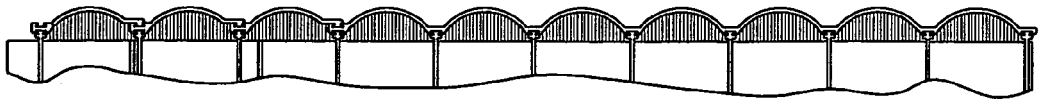
Figure 24:
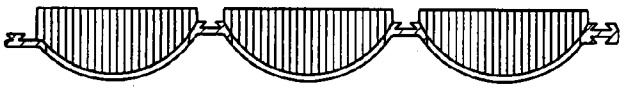
FIG. 24 is a top sectional view of a relatively narrow front member piece.

Once the glide has been assembled, it is easy to modify the glide to accommodate different sized containers by removing the initial front member, repositioning the walls (including adding or removing walls as may be necessitated by the different size of container) and then adding the new front member (either from the kit in which the glide originally came or new altogether). FIGS. 20–23 are partial semi-schematic top views of front members associated with four different container diameters all on a single width of base (formed by a primary piece and two auxiliary pieces). All utilize the standard base identified above. FIG. 20 shows an embodiment suitable for twelve-oz. (355 ml) soft drink cans having a seven-lane primary front piece and three one-lane auxiliary members. FIG. 21 shows a sixteen/twenty-oz. (473/591 ml) plastic carbonated beverage bottle embodiment having a six-lane primary front member and three one-lane auxiliary members. FIG. 22 shows a one-liter plastic carbonated beverage bottle embodiment having a six-lane primary member and two one-lane auxiliary members. FIG. 23 shows a thirty-two-oz. (946 ml) fruit drink bottle embodiment having a five-lane primary member and two one-lane auxiliary members. In these four illustrated embodiments, the primary front member has a width associated with the maximum number of lanes available on the primary base member. The next lane over, fronted by the first auxiliary front member, overlaps the seam or junction between the primary base member and first auxiliary base member. Where there is more than one auxiliary front member, one of the additional auxiliary front members overlaps each additional seam/junction between auxiliary base members. To facilitate mixing and matching of container sizes in a given display, a narrower primary front member may be used (e.g., a three-lane embodiment for sixteen/twenty-oz. (473/591 ml) plastic carbonated beverage bottles as shown in FIG. 24) allowing multiple front member pieces to be used within the width of the primary base member.

Figure 25:
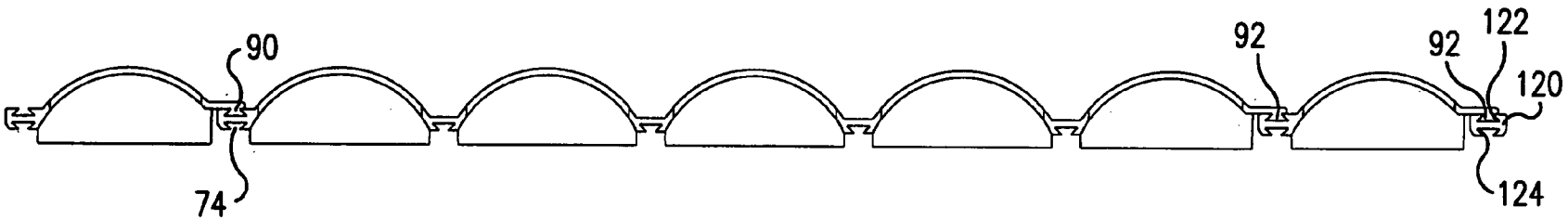
FIG. 25 is a top sectional view of an alternate front for the glide of FIG. 1.

FIG. 25 shows an alternate front member which may be largely similar to the previously-identified front members. A key difference is that the primary front member is equipped with interengagement features similar to the previously identified auxiliary front members so as to allow auxiliary front members to be added to either side of the primary front member. Namely, at an extreme first side (the right side in the illustrated embodiment) the primary front member can include the same channels 74 and 90 previously described for the primary and auxiliary front members. However, at the second side (left in the illustrated embodiment) it includes a projection 92 similar to that previously noted only for the auxiliary front members. In the illustrated example of FIG. 25, one auxiliary front member is thus attached to the right of the primary front member and one is attached to the left of the primary front member. To complete this front member, an adapter 120 is included having a first vertically extending dovetail channel 122 for engaging the projection 92 at the extreme second side of the assembled front member. The adapter includes a second channel 124 dimensioned and positioned to engage the projection 60 of the wall member at the second (left as illustrated) side of the plurality of walls 26.

One or more embodiments of the present invention have been described. Nevertheless, it will be understood that various modifications may be made without departing from the spirit and scope of the invention. For example, many construction techniques and materials may be utilized. Accordingly, other embodiments are within the scope of the following claims.

What is claimed:

1. A retail display glide apparatus for holding a plurality of items, comprising:

a base including a front end, a back end, a left end, a right end, an upper surface for supporting the items, a bottom surface defining an axis and at least one slot extending from the upper surface towards the bottom surface;

a plurality of wall members, at least one of the plurality of wall members removably installable on the base and extending front-to-back to cooperate with the base to define a plurality of channels, each channel dimensioned for accommodating an associated front-to-back column of the items and each wall member including a top edge, a bottom edge, a front edge, a rear edge and at least one wall member including at least one projection depending from the bottom edge, the at least one projection having a forward-directed finger extending therefrom, wherein the wall members are installable on the base by inserting the projection downward into the slot in the base and shifting the wall member forward with respect to the base; and a front member selectively installable to at least one wall member which bounds forward extremities of the channels.

2. The retail display glide apparatus according to claim 1, wherein the slot extends from the upper surface of the base through the bottom surface of the base, wherein the projection is inserted through the slot so that an upper surface of the finger contacts the bottom surface of the base and wherein at least a portion of the upper surface of the finger is substantially parallel to the axis of the bottom surface when the wall member is installed on the base.

3. The retail display glide apparatus according to claim 1, wherein at least one channel is dimensioned to accommodate at least one beverage container.

4. The retail display glide apparatus according to claim 1, wherein the base comprises a molded plastic primary base member and at least one molded plastic auxiliary base member removably assembled side by side, the primary base member being wider than at least one auxiliary base member; and the front member including a molded plastic primary front member and at least one molded plastic auxiliary front member removably assembled side by side, the primary front member being wider than at least one auxiliary front member.

5. The retail display glide apparatus according to claim 1, wherein the base includes at least three slots and at least one wall member includes at least three projections.

6. A retail display glide apparatus for holding a plurality of items, comprising:

a base having front, back, left, and right ends, an upper surface for supporting the items, a bottom surface, and at least one slot extending from the upper surface to the bottom surface;

a plurality of wall members, at least one of the plurality of wall members removably installable on the base and extending front to back so as to cooperate with the base to define a plurality of channels, each channel dimensioned for accommodating an associated front to back column of the items and at least one of the plurality of wall members including a projection depending from a bottom edge thereof, the projection having a forward-extending finger extending therefrom; and a front member removably installable to at least one of the plurality of wall members which bounds forward extremities of the channels, wherein the wall members are installable on the base by inserting the projection downward through the slot in the base and shifting the wall member forward with respect to the base, and wherein the bottom surface of the base remains substantially parallel with the bottom edge of the wall member during installation of the wall member on the base.

7. The retail display glide apparatus according to claim 6, wherein the front edge of each wall member includes a vertically-extending projection engagable via vertical translation to a complementary channel in the front member.

8. The retail display glide apparatus according to claim 7, wherein the front member includes surfaces cooperating with complementary surfaces of the base to reduce the possibility of a shift of the installed wall members and to reduce the possibility of removal of the installed wall members unless the front member is at least partially uninstalled via vertical translation.

9. The retail display glide apparatus according to claim 6, wherein the base includes a molded plastic primary base member and at least one molded plastic auxiliary base member removably assembled side by side, the primary base member being wider than at least one auxiliary base member and wherein the front member includes a molded plastic primary front member and at least one molded plastic auxiliary front member removably assembled side by side, the primary front member being wider than at least one auxiliary front member.

10. The retail display glide apparatus according to claim 6, wherein at least one channel is dimensioned to accommodate at least one beverage container.

11. The retail display glide apparatus according to claim 6, wherein the base includes at least three slots and at least one wall member includes at least three projections.

12. A retail display glide apparatus for holding a plurality of items, comprising:

a base having front, back, left, and right ends, an upper surface for supporting the items, a bottom surface, at least one slot extending from the upper surface to the bottom surface;

a plurality of wall members, at least one of the plurality of wall members removably installable on the base and extending front to back so as to cooperate with the base to define a plurality of channels, each channel dimensioned for accommodating an associated front to back column of the items and at least one of the plurality of wall members including a projection depending from a bottom surface thereof, the projection having a forward-extending finger extending therefrom; and a front member installable to at least one of the plurality of wall members which bounds forward extremities of the channels, wherein the wall members are installable on the base by inserting the projection downward through the slot in the base and shifting the wall member forward with respect to the base; and wherein the base includes:

right and left side walls;

a plurality of front-to-back rails; and a plurality of cross-members spanning between the sidewalls, wherein the cross-members, side walls and rails combine to form a grid of apertures, the apertures receive the installable wall members and are positioned on the base so as to permit the wall members to be installed in one or more of a plurality of pitches.

13. The retail display glide apparatus according to claim 12, wherein the side walls and the rails have a width of about 0.095 inches, the apertures have a width of about 0.100 inches and a width from a first aperture of the grid of apertures to an adjacent second aperture of the grid of apertures is about 0.195 inches.

14. The retail display glide apparatus according to claim 13, wherein the plurality of pitches are a multiple of the aperture to aperture width of about 0.195 inches.

15. A retail display glide apparatus for holding a plurality of items, comprising:

a base having front, back, left, and right ends, an upper surface for supporting the items, a bottom surface, and at least one slot extending from the upper surface to the bottom surface;

a plurality of wall members, at least one of the plurality of wall members removably installable on the base and extending front to back so as to cooperate with the base to define a plurality of channels, each channel dimensioned for accommodating an associated front to back column of the items and at least one of the plurality of wall members including a projection depending from a bottom surface thereof, the projection having a forward-extending finger extending therefrom; and a front member installable to at least one of the plurality of wall members which bounds forward extremities of the channels, wherein the wall members are installable on the base by inserting the projection downward through the slot in the base and shifting the wall member forward with respect to the base; and wherein the base includes a grid of apertures, the apertures receive the installable wall members and are positioned on the base so as to permit the wall members to be installed in one or more of a plurality of pitches.

16. A kit for forming a retail display glide apparatus which holds a plurality of containers, comprising:

a primary base member having front, back, left, and right ends, an upper surface which supports the containers, a bottom surface, and at least one slot extending from the upper surface to the bottom surface;

a plurality of auxiliary base members each having front, back, left, and right ends, an upper surface which supports containers, a bottom surface, and at least one slot extending from the upper surface to the bottom surface, the plurality of auxiliary base members being configured for selective assembly with the primary base member in side by side configuration to form a glide base;

a plurality of wall members, at least one of the plurality of wall members being selectively installable on the primary base member extending front to back to cooperate with the base to define a plurality of channels, each channel accommodates an associated front to back column of the containers and at least one of the plurality of wall members including at least one projection depending from a bottom surface thereof and the projection having a forward-extending finger, wherein at least one of the plurality of wall members is installable on the base by inserting the projection downward at least partially through the slot in the base and shifting the wall member forward with respect to the base; and at least two front member assembly kits respectively associated with the at least two channel widths, each comprising:

a primary front member having front and back surfaces and top, bottom, left, and right edges; and a plurality of auxiliary front members, each having front and back surfaces and top, bottom, left, and right edges and being configured for selective assembly with the primary front member to form a front member assembly, the front member assembly attachable to at least one of the wall members to bound forward extremities of the channels.

17. The kit according to claim 16, wherein each front member assembly includes a plurality of concave surface portions along the back surfaces of its primary and auxiliary front members and is aligned with the plurality of channels for accommodating the front container in each associated column.

18. The kit according to claim 16, wherein the primary base member and auxiliary base members are each single pieces of molded plastic each including a plurality of pairs of front and back longitudinal apertures;

each wall member including top, bottom, front, and back edges with a plurality of holes inboard of said edges and a vertically-extending projection along the front edge; and each front member assembly including a plurality of vertically-extending channels complementary to the vertically-extending projections to interlock the front member assembly with the installed wall members upon a relative vertical translation.

19. The kit according to claim 16, wherein the base includes at least three slots and at least one wall member includes at least three projections.

* * * * *